US011100816B2

(12) United States Patent
Koivisto

(10) Patent No.: US 11,100,816 B2
(45) Date of Patent: Aug. 24, 2021

(54) METHOD FOR SELECTING A FACE MATERIAL FOR A PRINTABLE LABEL AND A PRINTED LABEL

(71) Applicant: UPM Raflatac Oy, Tampere (FI)

(72) Inventor: Markku Koivisto, Kauniainen (FI)

(73) Assignee: UPM RAFLATAC OY, Tampere (FI)

( * ) Notice: Subject to any disclaimer, the term of this patent is extended or adjusted under 35 U.S.C. 154(b) by 0 days.

(21) Appl. No.: 16/500,909

(22) PCT Filed: Apr. 18, 2017

(86) PCT No.: PCT/FI2017/050292
§ 371 (c)(1),
(2) Date: Oct. 4, 2019

(87) PCT Pub. No.: WO2018/193151
PCT Pub. Date: Oct. 25, 2018

(65) Prior Publication Data

US 2020/0126453 A1 Apr. 23, 2020

(51) Int. Cl.

| | |
|---|---|
| ***G09F 3/00*** | (2006.01) |
| ***B41J 3/407*** | (2006.01) |
| ***B41M 3/14*** | (2006.01) |
| ***G09F 3/03*** | (2006.01) |
| *G09F 3/02* | (2006.01) |

(52) U.S. Cl.
CPC ..... *G09F 3/0297* (2013.01); *B41J 3/4075* (2013.01); *B41M 3/14* (2013.01); *G09F 3/03* (2013.01); *G09F 2003/0201* (2013.01); *G09F 2003/0229* (2013.01)

(58) Field of Classification Search
CPC ..... G09F 3/0297; G09F 3/03; B41J 3/4075; B41M 3/14
USPC ..... 235/494
See application file for complete search history.

(56) References Cited

U.S. PATENT DOCUMENTS

2011/0123753 A1 5/2011 Koger et al.

OTHER PUBLICATIONS

International Search Report for the corresponding International Application No. PCT/FI2017/050292; International Filing Date: Apr. 18, 2017; dated Jan. 22, 2018; 3 pages.
Written Opinion of the International Searching Authority for the corresponding International Application No. PCT/FI2017/050292; International Filing Date: Apr. 18, 2017; 7 pages.

*Primary Examiner* — Daniel A Hess
(74) *Attorney, Agent, or Firm* — Cantor Colburn LLP

(57) ABSTRACT

The invention relates to a method for selecting a face material for a printable label and to a printed label comprising the face material, which is selected by the method. According to an embodiment the method comprises preselecting steps, printing step(s) comprising printing of the preselected face materials using printing method(s) providing a human-readable information and a machine-readable information, evaluating steps, and a final selecting step comprising selecting of the face material, which comprises the human-readable information exhibiting a halftone resolution at least 30 L/cm and the machine-readable information exhibiting final data area module size less than 1.0 mm.

17 Claims, 2 Drawing Sheets

METHOD FOR SELECTING A FACE MATERIAL FOR A PRINTABLE LABEL AND A PRINTED LABEL

CROSS-REFERENCE TO RELATED APPLICATIONS

This application is a National Stage application of PCT/FI2017/050292, filed Apr. 18, 2017, which is incorporated by reference herein in its entirety.

TECHNICAL FIELD

The present invention relates to a method for selecting a label face material and a printed label comprising a face material, which is selected by the method.

BACKGROUND

Generally labels have visual appearance including graphics data and/or information that can be detected and read by humans i.e. the data is represented in a human-readable format. In addition, there are labels including machine-readable data, which is primarily designed for reading by computers, electronic, mechanical or optical devices. Machine readable information may be provided as, for example, linear barcodes. Machine readable information may be used, for example, in identification systems for eliminating the possibility of human error so as to improve traceability, accuracy and/or security of the products and manufacturing processes.

US2011/0123753 relates to high opacity printable films or laminates.

SUMMARY

It is an aim to provide a method for selecting a face material to optimize quality of the printed labels, which include both human-readable information and machine-readable information. It is further an aim to reduce the variation in quality of the printed labels.

According to an embodiment, a method for selecting a face material for a printable label comprises the following steps: a first preselecting step, a second preselecting step, printing step(s), a first evaluating step, a second evaluating step, and a final selecting step. The first preselecting step includes selecting the face materials based on requirements of an end-use area of the printable label. The second preselecting step comprises selecting the face materials of the first preselecting step, which face materials have surface energy level at least 38 dynes/cm. The printing step(s) comprises printing of the face materials of the second preselecting step using printing method(s) providing a human-readable information and a machine-readable information. The first evaluating step comprises measuring a halftone resolution of the human-readable information. The second evaluating step comprises measuring a final data area module size of the machine-readable information. The final selecting step comprises selecting of the face material(s), which comprises the human readable information exhibiting the halftone resolution at least 30 L/cm and the machine readable information exhibiting the final data area module size less than 1.0 mm.

According to an embodiment, a label structure comprising a face material selected according to the method is provided.

Further embodiments of the application are presented in the dependent claims.

In an example, the printing step is combined printing step wherein both the human-readable information and the machine-readable information are provided simultaneously using a non-contact based printing method.

In an example, the printing step includes a first printing step comprising printing of the face materials of the second preselecting step using a contact based printing method providing a human-readable information and a second printing step comprising printing the preselected face materials of the second preselecting step using a non-contact based printing method providing a machine-readable information.

In an example, the second preselecting step further includes selecting the face materials having an opacity at least 60%, when measured according to ISO 2471 standard.

In an example, the contact based printing method is selected from the following methods: flexo printing, offset printing, gravure printing and screen printing.

In an example, the non-contact based printing method is selected from the following methods: laser printing and inkjet printing.

In an example, the human-readable information comprises ink thickness of between 0.5 and 25 μm.

In an example, the machine-readable information exhibits the final data area module size less than 0.8 mm or less than 0.4 mm.

In an example, the machine readable information consists of 2-dimensional code. The 2-dimensional code may be a QR-code. The QR-code may be merged into an image of the human-readable information.

In an example, the method further comprises a pre-printing step comprising printing of the face material so as to provide a background colour, wherein the machine-readable information is provided.

In an example, the label comprises a human-readable information and a machine-readable information printed onto a first surface of the face material.

In an example, the face material comprises a security printing on a reverse side of the face material.

In an example, the label structure is a pressure sensitive adhesive label comprising a pressure sensitive adhesive layer on the reverse side of the face material. Alternatively, the label is a heat shrink label.

BRIEF DESCRIPTION OF THE DRAWINGS

In the following examples, the embodiments of the invention will be described in more detailed with reference to appended drawings, in which.

DETAILED DESCRIPTION

In this description and claims, word "comprising" may be used as an open term, but it also comprises the closed term "consisting of". Unit of thickness expressed as microns corresponds to μm. Unit of temperature expressed as degrees C. corresponds to ° C. Further, the following reference numbers are used in this application:

1 2-dimensional optical code (QR-code),
2 position detection pattern,
4 module (individual geometric pattern),
6 data area,

8 human-readable information,
10 label,
12 security print,
14 an item,
141 a labelled item,
100 first preselecting step,
101 second preselecting step,
102 first printing step,
103 first evaluating step,
104 second printing step,
105 second evaluating step,
106 final selecting step.

Figure 3:
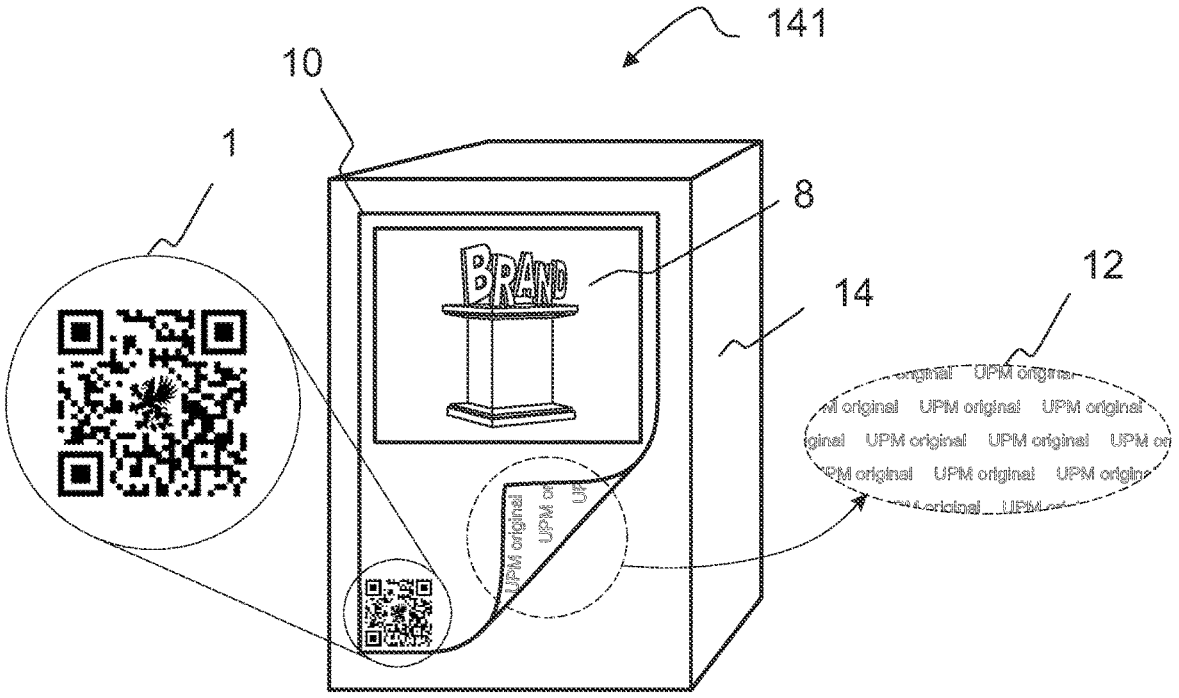
FIG. 3 illustrates an example of a label attached onto a surface of an item.

Label is a piece of material, which is used to provide information and/or visual appearance of a product to which it is attached. Same label may comprise both human-readable i.e. eye-readable information and machine-readable information. Human-readable information may provide information regarding the product for customers. It may also provide visual appearance for the product, including an image and brand information. Human-readable information usually remains same for all individual products of the same type. Thus, human-readable information may also be called as non-variable information as it does not change per individual package. An example of a labelled item 141, wherein a label 10 is attached onto a surface of an item 14 is shown in FIG. 3. The item may comprise only one label. Alternatively, it may comprise several labels. For example a primary label on the front side of the item and a secondary label on the back side of the item. Secondary label may also be, for example, in the neck of the bottle. At least one of the labels comprise both the human-readable information and the machine-readable information. Machine-readable and human-readable information are provided by printing a face material of the label. Printing provides a print layer, which is machine-readable or human-readable.

Machine-readable information may be individual/unique per individual package labelled or same production batch. Machine-readable information may comprise variable information. Machine-readable information may be used to provide an individual verification or authenticity information for each of the products.

Machine readable information may be provided as an optical 1-dimensional or 2-dimensional code. The code may be used to verify the origin and/or authenticity of the individual product. In addition, the machine-readable codes may be used to assist logistics, sales and after sale promotion and/or guarantee of the products.

The code may be used to provide variable information, such as authenticity of the product unique per individual package labelled or same production batch.

Such variable information is static and stays the same during life-cycle of the product labelled. Alternatively, variable information may be dynamic. Dynamic information is information, which changes e.g. updates during the life-cycle of the product labelled. Dynamic information may include for example additional services or additional, updated data, such as logistic data, weather data, recipe suggestions etc.

The code may be a matrix barcode, such as QR-code (quick response code). A QR-code consists of black geometric patterns, such as squares, arranged in a square grid on a white background. Geometric patterns provide position detection patterns and data area. The geometric patterns can be read by an imaging device such as a camera or smartphone comprising QR code scanner. Read code may be further processed using error correction until the image can be appropriately interpreted.

Machine-readable information, such as QR-code, can be also visualised, for example, in order to make it more noticeable and to attract customers to scan it. Visual QR-code can be provided by merging the code into an image of the human-readable information. When the QR-code is merged within the image, it retains its code-like appearance so that it is obvious that it is to be scanned. However, when represented within, for example, a colourful, attractive image it can be blend in more natural way with the rest of the design instead of marring the overall image of the label. Visualised QR-code may have effect on providing customer an incentive to access the code for further information, for example, a code giving further information on usage of the goods in the specific environment.

QR-codes are used to redirect their scanners to a set destination such as a URL, a Google map location, a YouTube video or a profile page of social network. The destination may include dynamic information or static information. QR-codes can also be used for many other functions such as transmitting electronic business cards, calling via Skype and sharing statuses via social networks.

QR-codes are increasingly popular in many fields such as consumer advertising, purchasing, social media and security. In the commercial industry codes may be used to provide the customer with quick accessibility to information, such as the brand's website or a store's location. In addition, their use can be tracked. Thus supplying their creators with valuable data such as number of scans taken.

Machine-readable information and/or human-readable information may be printed onto a first surface (top surface) of the face material. Label comprising print layer(s) is referred to as a printed label.

In addition the label may comprise additional security feature(s), such as an additional printing (security printing) on the second surface i.e. reverse side of the face material of the label. Security printing is not visible through transparent face material. Printing may be provide, for example, by using UV-reactive inks, wherein the print is visible only when exposed to UV-light. Such security features may be used in tamper-proof labels so as to guarantee not only the origin of the label but also validity of the information provided in the label.

In addition the label may comprise overcoating (also referred to as top coating) so as to enhance the durability of the printed label. Overcoating is preferably provided during or after printing of the label so as to coat the printed layer. Overcoating may also improve the contrast of the label. Thus, it may improve, for example, the optical reading of the machine-readable information.

According to an example, a label includes a specific surface coating layer on the face material surface onto which the printing, i.e. machine and/or human readable information, is provide. Such coating layer may be a primer coating layer, varnish layer, barrier layer or any other layer being able to enhance the printing and/or print quality, such as anchorage of the printing ink. In an example printing ink may soften the varnish layer and diffuse into the layer so as to provide enhanced ink anchorage.

Labels comprising visual appearance and information, may be used in variety of labelling applications and end-use areas, such as food and beverage labelling, home and personal care product labelling, pharmaceutical and health care labelling, labelling of industrial products, brand protection and security labelling, and transport and logistics labelling.

A label may be a pressure sensitive adhesive label (PSA label). A PSA label includes a face material layer and pressure sensitive adhesive layer. A PSA label may also be referred to as a pressure sensitive label (PSL). The adhesive layer is attaching the label to the surface of an item to be labelled. The PSA label can be adhered to most surfaces through an adhesive layer without the use of a secondary agent, such as a solvent, or heat to strengthen the bond. The PSA forms a bond when pressure is applied onto the label at ambient temperature (e.g. between 15 and 35° C.), adhering the label to the item to be labelled. Examples of pressure sensitive adhesives include water based (water-borne) PSAs, solvent based PSAs and solid PSAs. Solid PSAs are melted during application to the surface to be coated and may also be referred to as a hot-melt PSAs. Face material of a PSA label may be either plastic or paper based.

A label laminate refers to a continuous web structure, comprising a face material layer, a pressure sensitive adhesive layer and a release liner. Release liner is a material layer used for protecting the adjacent adhesive layer. It also allows easier handling of the label laminate structure up to the point of labelling where the label structure is dispensed and adhered to a surface of an item. In a labelling step the release liner is removed and disposed of. Release liner serves one or more useful functions: it is used as a carrier sheet onto which the adhesive may be coated; it protects the adhesive layer during storage and transportation; it provides support for labels during die-cutting and printing, and ultimately it releases from the adhesive leaving it undamaged.

Alternatively, a label may be a shrink label. Shrink label may be referred to as a shrink sleeve. In a shrink label the face material is shrunk around an item to be labelled. Shrink label comprises plastic face material which has shrinkage capability when exposed to external energy, such as elevated temperature. When using shrink labels, the shrinkage of the film affects the design of the human-readable and machine-readable information of the label. For example, it should be taken account that also the printed image shrinks to a certain extent i.e. in proportion to shrinkage of the film. Thus, a QR-code printed onto a shrink label has final size of the code including final data area module size only after the label is shrunk.

A face material of a label may be either plastic or paper based material. Plastic face materials may be preferred, for example due to water resistance, transparency and mechanical properties. A plastic face material may comprise thermoplastic polymers, such as polyolefin(s), polyester(s), polystyrene(s), polyurethane(s), polyamide(s), poly(vinylchloride)(s) or any combination of these. Polyolefins include polyethylene (PE) and polypropylene (PP) homo- and copolymers. Alternatively, the plastic face material may be biodegradable, such as lactic acid, starch and/or cellulose based. Alternatively, the face material may comprise or consist of other wood based material, such as plywood, fiber based woven or non-woven fabric, metallic layer, such as aluminium, or any combination of these. The face material may comprise or consist of natural based materials.

In addition, face material may comprise additives, such as pigments or inorganic fillers to provide, for example, desired colour or opaqueness for the face. Alternatively, the plastic face material may be cavitated so as to provide opaque (white) appearance.

Face material may have a monolayer structure. Alternatively it may have a multilayer structure comprising two or more layer. In an example, a face material may have a three layer structure. According to an example a face material comprises a coating on a face material surface onto which the printing, i.e. machine and/or human readable information, is provided. Such coating layer may be a primer coating layer, barrier layer or any other layer being able to enhance the printing and/or print quality, such as anchorage of the print. Face material may further be top coated in order to alter finish of the label and protect the face material from the damage during storage and use.

Face material selection of a label depends, among other things, on the end use requirements of the labelled product and visual appearance/design of the label. Other aspects are, for example, type of a package to be labelled, adhesive type and environmental requirements e.g. freeze durability of the label.

The face layer may be transparent or clear. Transparent (clear) labels are substantially transparent to visible light. Transparency provides "no label look" appearance for the label, which is advantageous, for example, in labelling applications where the objects beneath the label should be visible through the label. Clarity of the face material is measured and evaluated by the haze value. Haze relates to scattering of light by a plastic face film that results in a cloudy appearance of the film. Haze corresponds to the percentage of light transmitted through a film that is deflected from the direction of the incoming light. Haze may be measured according to standard ASTM D1003. Transparent face material exhibits haze less than 25% or less than 10%, for example between 2 and 6%, or between 4 and 5%, when measured according to standard ASTM D1003.

Alternatively, the face material may be opaque and/or white. Opacity is a property of material that describes an amount of light which is transmitted through it. Opaque appearance of the plastic face material may be provided either by cavitation of the face material or using pigments. Paper comprising cellulose fibres piled up in the paper web diffuses the light passing through the paper sheet, thus imparting opacity of the paper as such. Fillers, such as clay, titanium oxide, calcium carbonate may be added to increase the opacity of the paper. Tinting and dyeing also increase the opacity of the paper.

An opaque face material may have opacity at least 60%, or at least 75% or at least 80%, when measured according to standard ISO 2471. Opacity of a face material may be between 60 and 97%. Face material based on paper may have opacity between 75 and 97%. Face material based on plastic may have opacity between 60 and 95%. In an example, if the face material is metallized i.e. comprises multilayer structure including a metallized layer, the opacity may be 100%.

Gloss refers to a quality of a face material that causes it to appear shiny. When light hits a material's surface, the orientation of the reflected light rays determines it's gloss. For example, a paper that has undergone calendering, or coating, or has had its surface highly polished, will reflect the light primarily as parallel rays, or all in the same direction. This is what causes a paper surface to be "glossy." The opposite of a glossy surface is a matte surface. In matte surface the light rays that strike the surface are reflected in different directions (or more diffusely) due to small surface contours. Gloss is also related to the smoothness of the face material, such as paper smoothness. In an example, matt face material of paper may have gloss value of 25%, when measured using Hunter at 75°. Matt plastic face material may have gloss equal or below 10%, when measured using DIN 67530/1 at 60°. In an example, glossy paper may have gloss value of 64%, when measured using Hunter at 75°. Glossy plastic face material may have gloss of 80%, when measured using DIN 67530/2 at 45°.

Surface tension (wettability) of the face material may also be used to judge surface characteristics of the material related to e.g. printability. For printability the face material surface needs to have sufficiently high surface energy level determining of wetting characteristics of the face material. Surface energy can't be measured directly. The surface energy level can be deduced by measuring substitute property of wetting tension, which involves observation of the behaviour of liquids placed on the film surface e.g. according to the standard ASTM D-2578. Wetting tension is the maximum liquid surface tension that will spread on the film surface. Thus, the wetting tension is a measurable property estimating the surface energy of the film. A low surface energy may lead to poor retaining capability of printing ink applied to the surface. For example, a printable face material may have a wetting tension clearly above 30 dynes/cm, for example at least 36 dynes/cm and above, preferably at least 38 dynes/cm, or even above at least 44 dynes/cm, when measured according to the standard ASTM D-2578. Thus, a printable face material has surface energy level preferably at least 38 dynes/cm. Surface tension may also be measured according to FINAT test method no. 15, wherein the surface tension is measured by applying to the surface of the face material a test fluid of known surface tension (mN/m).

The materials used in a label have an impact on the success of the label in the specific labelling application. There are requirements for finding not only economical but also materials that enable optimal performance of the label so as to avoid returns or complaints of the customers. The requirements may be met by adopting a specific approach to the face materials selection process.

Figure 1:
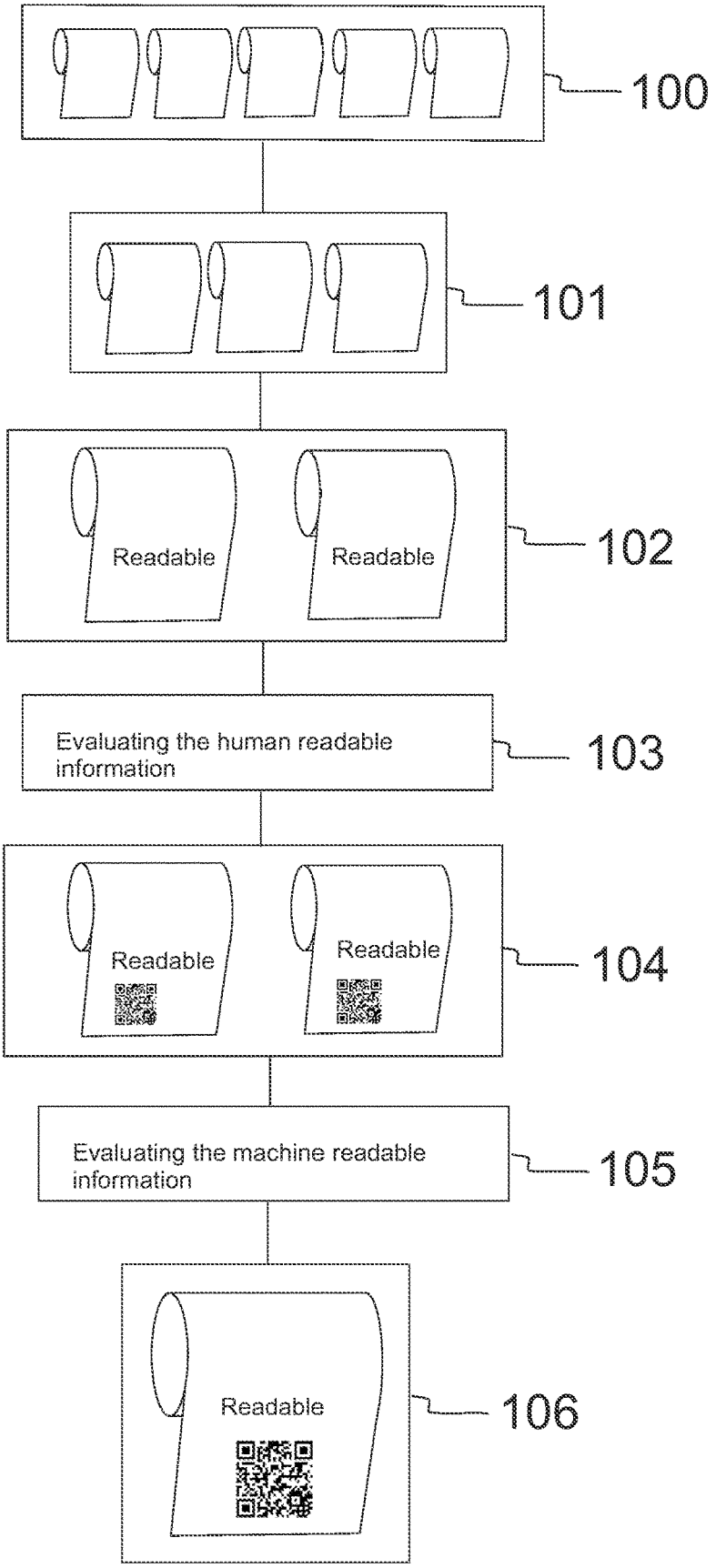
FIG. 1 illustrates a flow chart according to an embodiment of a method for selecting a face material.

With reference to FIG. 1, a method for selecting an optimal face material for a printable label may comprise following steps: a first preselecting step 100, a second preselecting step 101, a first printing step 102, a first evaluating step 103, a second printing step 104, a second evaluating step 105 and a final selecting step 106.

First preselecting step 100 of the face materials includes selecting of the face materials based on specific requirements set by the end-use area of the printable label, such as function and environment of the label. Specific requirements include, for example, performance requirements, size and shape requirements, cost requirements, manufacturing requirements, sustainability requirements, and mechanical properties requirements. With increasing number of requirements a number of potential face materials decreases. In an example, based on the end-use requirements of the label the face material may only be limited to paper based face materials or plastic based face materials. In an example, requirements of the shrink label, i.e. shrinkage capability when exposed to external energy, readily eliminates paper based face materials and the face materials are limited to plastic face materials having shrinkage potential.

Second preselecting step 101 of the face materials, includes selection made based on specific properties/requirements and limits of the face material relating to the printability of the face material. Label face material have at least the following properties porosity, surface roughness, surface energy level, opacity and gloss, which may be used for evaluating the face material suitability for high quality printing.

In a first instance second preselecting step 101 is provided on the basis of surface energy level of the face material. Preferably the face material exhibits surface energy level of at least 38 dynes/cm. Other parameters used for the preselecting the face material may be a gloss, haze and opacity. Preferably the matt face material has gloss equal or below 25%. Preferably the glossy face materials has gloss at least 64%. Preferably the opaque face material has opacity of at least 60%. Preferably the transparent face material has haze less than 10%.

After preselecting steps of the face materials(s), the method comprises a first printing step 102 comprising printing the preselected face material(s) with a first printing method providing a human-readable information. According to an example, the first printing method may comprise at least one of the following contact based printing methods: flexo printing, offset printing, gravure printing and screen printing.

Further, the method comprises a first evaluating step 103 for evaluating the human-readable information. Evaluation may comprise evaluation of the quality of the human-readable information. In an example, evaluation may comprise measuring a halftone accuracy of the printed human-readable information. A halftone is a group of dots that when viewed at a distance, have an appearance of continuous shades of grey or colour in an image. The resolution of halftone screen may be measured in lines per inch (Ipi), which is a number of lines of dots in one inch in a halftone or line screen. Halftone value may also be presented as a number of lines of dots per linear centimetre (L/cm). Dots per inch (dpi) value may be used to measure the resolution of a printer. In printing the number of lines per inch depend on the dpi of the output device and also on the properties of the material to be printed. Pixels per inch (ppi) may be used for the number of pixels per inch in screen/scanner file terms. Human-readable information may be measured and evaluated based on standard ISO 12647-1. Alternatively or in addition, the quality of human-readable information may be evaluated by determining the macroscopic characters such as the tone and color reproductions, and the microscopic characteristics such as sharpness and granularity.

Further, the method comprises a second printing step 104. The second printing step includes printing the preselected face material(s) with a printing method providing machine-readable information 104. The printing method may be at least one of the following non-contact based printing methods: laser printing and inkjet printing. Machine readable information may be provided as an optical 2-dimensional barcode. The code may be a matrix barcode, such as QR-code (quick response code) consisting of black squares arranged in a square grid on a white background. The printing method and number of dots in the printer head (dpi) has effect on the module size and print quality of the machine-readable information. Preferably each of the modules is made up of 4 or more dots.

Figure 2:
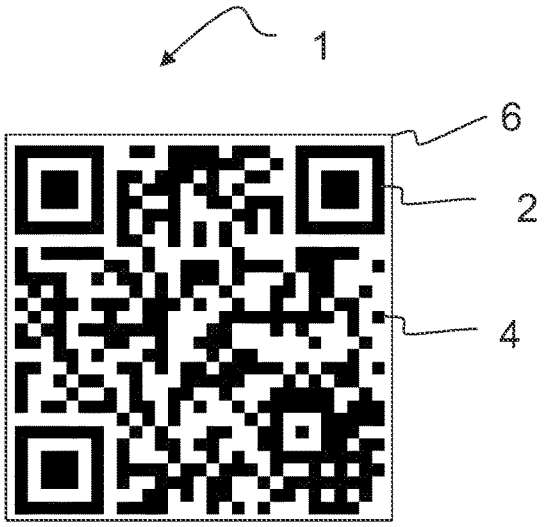
FIG. 2 illustrates an example of 2-dimensional optical QR-code

Further, the method comprises a second evaluating step 105 for evaluating the machine-readable information. Evaluation may comprise measuring a final data area module size of the machine-readable information. With reference to FIG. 2, data area module size is a measure of an individual geometric pattern 4, referred to as a module, such as black and white square, of the data area 6 of the QR-code. The QR-code 1 further comprises position detection patterns 2, which are not used for measuring module size. The final data area module size refers to the actual module size of the printed QR-code of the label. The final data area module size of the PSA label corresponds to the data area module size after printing of the face material. The final data area module size of the heat shrink label corresponds to the data area module size after the label is shrunk i.e. after the printed face material is shrunk.

Last step of the method is final selecting of the face material. Final selecting of the face material comprises approving/selecting the face material, wherein the face material comprises human-readable information exhibiting halftone resolution (accuracy) at least 30 L/cm and the machine-readable information exhibiting a final data area module size less than 1.0 mm. Human-readable information may exhibit halftone resolution, for example, between 30 and 90 L/cm.

According to an example, the first printing step and the second printing step may be provided in a combined manner including one combined printing step wherein both human-readable and machine-readable information are provided simultaneously. The combined printing step comprises non-contact based printing method(s). After combined printing step, both the human readable information and the machine readable information are evaluated as disclosed above. In one example, the combined printing step consists of non-contact based digital printing, which is provided in a digital printing machine. In an example, the combined printing step consists of laser printing. Alternatively, the combined printing step consists of inkjet printing. In a second example, the combined printing step consist of contact based printing and non-contact based digital printing, which are provided in a single hybrid printing machine.

The method may further comprise a pre-printing step providing background colour for machine-readable print. The further pre-printing step is provided either before combined printing step or before the second printing step, wherein the machine-readable information is provided.

According to an example, the method may further comprise a third printing step comprising printing of the face material prior to the second printing step so as to form background colour, such as a white print area wherein the machine-readable information is provided. Background colour may have a colour providing suitable opacity and contrast within the data area 6 and especially between the modules of the QR-code. In other words, the machine-readable information is provided on top of the background colour print area.

In addition the method may comprise still further printing steps, such as printing providing security printing 12 on the reverse side of the face material. Reverse side of the face material is opposite the surface of the face material, in which the human-readable information 8 and machine-readable information 1 are provided, as shown in FIG. 3. Security printing may be provide, for example, by using UV-reactive inks, wherein the print is visible only when exposed to UV-light.

The method may also comprise further steps, such as intermediate selecting steps of the face material. Intermediate selecting step may be provided between the first preselecting step and the final selecting step of the face material. For example, the method may comprise a third preselecting step of the face material after first printing step or after second printing step. In an example, face material(s) may be discarded based on the results of the evaluating steps. For example, face material having a halftone accuracy less than 20 L/cm may be discarded. For example, the face material having smallest size of the final data area module above 1.0 mm may be discarded.

The invention claimed is:

1. A label structure comprising a face material, wherein the face material has a surface energy level at least 38 dynes/cm and comprises human-readable information printed using a contact-based printing method, and machine-readable information printed using a non-contact based printing method, wherein the human-readable information exhibits a halftone resolution of at least 30 L/cm, and wherein the machine-readable information exhibits a final data area module size of less than 1.0 mm, wherein the face material is selected by a method comprising:

providing the face material which has been selected based on requirements of an end-use area of the printable label and has a surface energy level at least 38 dynes/cm;

printing the human-readable information on the face material using the contact based printing method;

printing the machine-readable information on the face material using the non-contact based printing method;

measuring the halftone resolution of the printed human-readable information; and measuring the final data area module size of the printed machine-readable information.

2. A label structure according to the claim 1, wherein the label comprises the human-readable information and the machine-readable information printed onto a first surface of the face material.

3. A label structure according to the claim 1, wherein the face material comprises a security printing on a reverse side of the face material.

4. A label structure according to claim 1, wherein the label structure is a pressure sensitive adhesive label comprising a pressure sensitive adhesive layer on the reverse side of the face material.

5. A label structure according to the claim 1, wherein the label is a heat shrink label.

6. A label structure according to claim 1, wherein the face material has an opacity at least 60%, when measured according to ISO 2471 standard.

7. A label structure according to claim 1, wherein the contact based printing method is selected from the following methods: flexo printing, offset printing, gravure printing and screen printing.

8. A label structure according to claim 1, wherein the non-contact based printing method is selected from the following methods: laser printing and inkjet printing.

9. A label structure according to claim 1, wherein the human-readable information comprises ink thickness of between 0.5 and 25 μm.

10. A label structure according to claim 1, wherein the machine-readable information exhibits the final data area module size less than 0.8 mm or less than 0.4 mm.

11. A label structure according to claim 1, wherein the machine readable information consists of 2-dimensional code.

12. A label structure according to claim 11, wherein the 2-dimensional code is QR-code.

13. A label structure according to claim 12, wherein the QR-code is merged into an image of the human-readable information.

14. A label structure according to claim 11, wherein the code is arranged to redirect a code scanner to a set destination selected from a group consisting of a universal resource locator, a map location, a video, and a profile page of social network.

15. A label structure according to claim 11, wherein the code is merged with an image of the human-readable information to provide a customer an incentive to access the code for further information, wherein the code, when accessed, is arranged to give further information on usage of goods in a specific environment.

16. A label structure according to claim 11, wherein packages of a production batch are labeled with labels of the label structure such that the human-readable information is non-variable, wherein the machine-readable information is unique, and wherein the code is arranged to provide variable dynamic information.

17. A label structure according to claim 1, wherein the human-readable information is non-variable, wherein the machine-readable information consists of 2-dimensional code, and wherein the code is arranged to provide variable dynamic information.

* * * * *